United States Patent [19]

Kleber et al.

[11] 4,080,301

[45] Mar. 21, 1978

[54] CONDITIONING AGENTS FOR THE TEXTURIZING OF POLYESTER FIBERS

[75] Inventors: Rolf Kleber, Neu-Isenburg; Gustav Dollinger, Egelsbach, both of Germany

[73] Assignee: Hoechst Aktiengesellschaft, Frankfurt am Main, Germany

[21] Appl. No.: 698,006

[22] Filed: Jun. 21, 1976

[30] Foreign Application Priority Data

Jun. 27, 1975 Germany ..... 2528734

[51] Int. Cl.[2] ..... D06M 13/20

[52] U.S. Cl. ..... 252/8.6; 8/115.6; 252/8.9; 428/291

[58] Field of Search ..... 252/8.6, 8.9, 9; 8/115.6; 428/291

[56] References Cited

U.S. PATENT DOCUMENTS

| | | | |
|---|---|---|---|
| 2,575,382 | 11/1951 | Duke et al. | 252/8.6 |
| 3,432,898 | 3/1969 | Stanley et al. | 252/8.6 |
| 3,639,235 | 2/1972 | Karg | 252/8.9 |
| 3,641,073 | 2/1972 | Buckley | 252/8.6 |
| 3,652,419 | 3/1972 | Karg | 252/8.6 |

*Primary Examiner*—William E. Schulz
*Attorney, Agent, or Firm*—Connolly and Hutz

[57] ABSTRACT

Conditioning systems for polyester fibers consisting of from 40 - 60% by weight of a lubricating agent and from 60 to 40% by weight of an emulsifying mixture, the total conditioning system showing a loss by evaporation of less than 5% by weight at 220° C within 1 hour, a viscosity of less than 200 cP (20° C), and in dilution with water in the ratio of 2:1, 1:1 and 1:2, a viscosity of less than 150 cP, less than 500 cP and less than 250 cP (60° C), respectively. These compositions are applied onto the fibers by known methods. They impart especially good sliding properties to the polyester fibers during texturizing.

2 Claims, No Drawings

CONDITIONING AGENTS FOR THE TEXTURIZING OF POLYESTER FIBERS

The present invention relates to conditioning agents for the texturizing of polyester fibers.

For the drawing and false-twist texturizing of synthetic polyester fibers, conditioning systems have been offered for several years, the development of which was effected mostly in a purely empirical way. According to "Chemiefasern", 1972, pp. 903 et seq., the composition of texturizing preparations of this kind can be specified as follows:

1. Lubricating agents controlling the sliding of the thread;
2. emulsifying agents whose function it is, besides emulsifying, to set the material and to guarantee the wash-off properties of the preparation;
3. antistatic agents;
4. agents for effecting a compactness of the thread;
5. rapid wetting agents;
6. bactericidal agents;
7. anticorrosive agents.

The physical requirements which have to be met by texturizing compositions of this kind have been described in detail in the above-mentioned literature. Thus, the preparation must not drop off by condensation (leave a carbonization residue on the heating elements), and it must be evenly distributed, in order to maintain a constant tension ratio at the twist device. The friction of the preparation must not be too high, for in this case it would lead to a breaking of the capillary tubes, in particular already in the drawing process, or to a breaking of the thread in the texturizing process. On the other hand, it must not be too smooth, for it would then result in a "slipping" at the twist device, and thus in untextured spots, so-called "closed" spots. Besides, the compositions must be resistant to high temperatures, since according to German Offenlegungsschrift No. 2 404 639, the thread is subjected to a temperature of 240° C. In order to meet these requirements, the individual components of conditioning systems of this kind have so far been chosen in a purely empirical manner, for example, ester oils, such as butyl stearate, or mineral oil nucleus fractions as lubricating components, and non-ionic oxethylated compounds and similar compounds as emulsifying agents (Chemiefasern 1972, pp. 903 et seq.).

A problem for the development of such systems, however, is still to be seen in the fact that it is very difficult to produce systems for practical use selectively, on the basis of laboratory tests, in which process up to now the selective criteria in the laboratory have been in most cases only the volatility of the components used as well as the stablility of the aqueous preparation formulation (in most cases from 15 to 20%).

It became evident that there are certain connections between the so-called sliding properties of a texturizing composition for polyester and parameters of a physical kind which can be determined in the laboratory, in a manner that — to obtain good texturizing results and a good previous drawing result in the case of polyester — only those systems can be used which show determined characteristics that are measurable physically. Therefore, in this case the chemical constitution of the individual components of this composition, which have in principle already been known for this purpose, is not the decisive factor, but it is important that these conditioning systems as a whole show determined characteristics that are measurable physically. The advantage of these conditioning systems is to be seen in the fact that there is no need to empirically test and optimize the respective individual components under varying mixing conditions and that these conditioning systems are generally suitable for the drawing and the false-twist texturizing of polyester, if they comply with the parameters given below which can be measured in a simple manner in the laboratory.

Thus, the present invention provides conditioning systems for polyester fibers consisting of from 40 to 60% by weight of a lubricant in the form of a. a mineral oil having a paraffin portion of from about 60 to 65% by weight, a naphthene portion of from about 30 to 35% by weight, a viscosity of less than 350 cP (20° C) and a loss by evaporation of less than 3% by weight at 220° C within 1 hour and/or b. an ester oil in the form of esters of trimethylolpropane and/or pentaerylthritol with saturated monobasic fatty acids having from 7 to 12 carbon atoms, the viscosity of which is below 100 cP at 37.8° C, and the loss by evaporation of which is less than 3% by weight at 220° C within 1 hour, as well as from 60 to 40% by weight of an emulsifying mixture consisting of 1. 40 to 70% by weight of an oxethylated oleyl alcohol having from 5 to 7 ethylene oxide units,
2. 0 to 30% by weight of an oxethylated castor oil having from 7 to 40 ethylene oxide units,
3. 10 to 25% by weight of neutralized reaction products of $POCl_3$ with oxethylated lauryl alcohol having from 2 to 4 ethylene oxide units, oxethylated wax alcohol having from 2 to 4 ethylene oxide units and/or oxethylated oleyl alcohol having from 2 to 10 ethylene oxide units, and
4. 0 to 20% by weight of oxethylated coconut oil acid, oleic acid and/or stearic acid having each from 5 to 15 ethylene oxide units, the total conditioning system showing a loss by evaporation of less than 5% by weight at 220° C within 1 hour, a viscosity of less than 200 cP (20° C), and when diluted with water in a ratio of 2 parts of total composition: 1 part of water, 1:1 and 1:2, a viscosity of less than 150 cP, less than 500 cP and less than 250 cP (60° C), respectively.

The total composition of the conditioning system may vary within the limits indicated above for the individual components, however, in every case the conditions for the volatility and the viscosity must be observed. Besides, the composition of the conditioning system has always to be chosen in a way that the proportion of lubricating agent is greater than the individual portions of emulsifying agents. Moreover, the conditioning preparation must be suitable to be applied from an aqueous emulsion, which means that the preparation in the form of an aqueous emulsion of 10 to 30% strength must remain stable over a longer period of time, i.e. for more than 8 days.

The application of the conditioning preparations is effected in known manner, for example, by spraying, dipping, padding, or by means of lick rollers. The amount of active substance applied onto the fiber is in the range of from 0.3 to 1.0% by weight, preferably from 0.4 to 0.7% by weight, calculated on the fiber weight.

The conditioning compositions of the invention are suitable for polyester fibers and the usual false-twist texturizing devices. These systems are also suitable for the processes of spin drawing, fast spinning (POY yarns), as well as of draw-texturizing according to the sequential and simultaneous methods, with regard to the newly developed machines used in these processes. The conditioning system of the invention for the false-twist texturizing of PES gives stable clear concentrates which, in the form of aqueous emulsions, partly show micro-emulsion characteristics. The high emulsion stability guarantees a satisfactory bath stability when working in practice. The conditioning system imparts to the hydrophobic fiber, besides the desired sliding properties in the drawing and texturizing processes, high antistatic values as well as an excellent compactness of the thread which permits to obtain a spun reelage of up to 15 kg, in particular in the fast spinning process, the unreeling of which in the (draw) texturizing process does not present any problems.

It is a surprising fact which could not have been foreseen that a conditioning system which contains a predominant proportion of unsaturated emulsifying agents on the basis of oleyl alcohol-oxethylated compounds shows such excellent thermostable properties, and that there is practically no yellowing effect when working in practice. It was also surprising that this mixture of emulsifying agents in conjunction with the lubricating components, when diluted with water, is kept within the specified viscosity parameters at 60° C, whereas the individual components, when diluted with water, by themselves or after the admixture of the lubricating agents, show thick gel phases which cannot be tolerated.

The following Examples illustrate the invention.

EXAMPLE 1

The following conditioning systems were examined in detail:

(1.)

40 Parts of mineral oil (20° C: 200 cP)
25 parts of stearyl alcohol · 8 units of ethylene oxide
15 parts of i-tridecyl alcohol · 8 units of ethylene oxide
11 parts of oleyl alcohol · 5 units of ethylene oxide
5 parts of sodium lauroyl sarcoside.

(2.)

50 Parts of mineral oil (20° C: 290 cP)
35 parts of oleyl alcohol · 6 units of ethylene oxide
15 parts of coconut-alkyldimethylaminoxide (German Offenlegungsschrift No. 2 326 966).

(3.)

According to the invention, 37 parts of mineral oil (20° C: 295 cP)
5 parts of pentaerylthritol-tetraheptanate
42 parts of oleyl alcohol · 5.5 units of ethylene oxide
5 parts of $POCl_3$ ester: basic $C_{12}H_{25}O$ (eth.ox.)$_2$H
5 parts of $POCl_3$ ester: basis $C_{16}H_{33}O$ (eth.ox.)$_8$H, both adjusted to pH 7 by means of NaOH,
4 parts of $H_2O$
2 parts of i-propanol.

The viscosity of the above systems was tested by means of a rotating viscometer. The following values were measured in this process:

| | Viscosity values (cP) | | | |
|---|---|---|---|---|
| | Dilution with $H_2O$ (60° C) | | | |
| pure (20° C) | 2:1 | 1:1 | 1:2 | |
| 1. 140 | 106 | 80 | 35 | |
| 2. 220 | 280 | 243 | 103 | |
| 3. 145 | 91 | 400 | 220 | (according to the invention) |

The volatility test at 220° C/1 h showed the following losses of active substance, the residues remaining liquid and hardly turning yellow:

| | | |
|---|---|---|
| 1. 9.3 % iodine color number[1)] | 40 | |
| 2. 6.3 % iodine color number[1)] | 100 | |
| 3. 2.9 % iodine color number[1)] | 20 | (according to the invention) |

[1)]Iodine color number: Yellowing scale in iodine color numbers (DIN 6162), measured following the volatility test.

The conditioning system 1 showed in fact a favorable viscosity behavior, however, the loss by evaporation was too high. The conditioning system 2 which had a higher thermostability showed in a dilution of 2:1 a viscosity increase which could not be tolerated. Only the mixture of the invention complied with all physical parameters.

The three liquid systems, whose aqueous emulsions of 15% strength (the emulsions having been prepared with water of 70° C and having been cooled afterwards) were stable for more than 8 days, were also subjected to a test in practice. A PES filament dtex 167 f 32 was spun with about 1100 m/min, and the preparations were applied from an aqueous emulsion of 15% strength by means of a lick roller. The air-conditioned spinning reels were drawn as usual and were then subjected to a false-twist texturizing process (amount applied: 0.6% of active substance). The following spinning and texturizing results were obtained:

a. Drawing behavior:

1. very good, no breaking of the capillaries;
2. moderate, sticking, liquids, breaking of the capillaries;
3. very good, no breaking of the capillaries;

b. Texturizing behavior:

| | Smoke development | Dropping off in the heating element | Texturizing result (crimping etc.) |
|---|---|---|---|
| 1. | yes, strong | yes | very good |
| 2. | minor | minor | good |
| 3. | none | no | very good |

These results show that only composition 3 according to the present invention yielded optimum results.

EXAMPLE 2

A POY yarn, PES dtex 167 f 32, was spun onto spinning reels having a cop weight of about 10 kg. Use was made of the conditioning systems of Example 1 with a coating amount of 0.45% of active substance (spinning rate about 3300 m/min).

In the subsequent draw-texturizing process (simultaneous process) the filaments treated with preparations 1 and 2 showed difficulties in the drawing-off in a way that there was a slipping-off of different layers on the drawing cops. Only the conditioning compound 3 showed an unobjectionable passage in the draw-texturizing process.

We claim:

1. Conditioning systems for polyester fibers consisting of from 40 to 60% by weight of a lubricating agent in the form of a. a mineral oil having a paraffin portion of from about 60 to 65% by weight, a naphthene portion of from about 30 to 35% by weight, a viscosity of less than 350 cP (20° C) and a loss by evaporation of less than 3% by weight at 220° C within 1 hour and/or b. an ester oil in the form of esters of trimethylol propane and/or pentaerylthritol with saturated monobasic fatty acids having from 7 to 12 carbon atoms, the viscosity of which at 37.8° C is below 100 cP, and whose loss by evaporation is less than 3% by weight at 220° C within 1 hour, as well as from 60 to 40% by weight of an emulsifying mixture consisting of 1. 40 to 70% by weight of an oxethylated oleyl alcohol having from 5 to 7 ethylene oxide units,
2. 0 to 30% by weight of an oxethylated caster oil having from 7 to 40 ethylene oxide units,
3. 10 to 25% by weight of neutralized reaction products of $POCl_3$ with oxethylated lauryl alcohol having from 2 to 4 ethylene oxide units, oxethylated wax alcohol having from 2 to 4 ethylene oxide units and/or oxethylated oleyl alcohol having from 2 to 10 ethylene oxide units, and
4. 0 to 20% by weight of oxethylated coconut oil, oleic and/or stearic acid having each from 5 to 15 ethylene oxide units, the total conditioning system showing a loss by evaporation of less than 5% by weight at 220° C within 1 hour, a viscosity of less than 200 cP (20° C), and in dilution with water in the ratio of 2:1, 1:1 and 1:2, a viscosity of less than 150 cP, less than 500 cP, and less than 250 cP (60° C), respectively.

2. A conditioning system as claimed in claim 1 consisting of 37 parts of mineral oil (20° C: 295 cP)
5 parts of pentaerylthritol-tetraheptanate
42 parts of oleyl alcohol · 5.5 units of ethylene oxide
5 parts of $POCl_3$ ester: basis $C_{12}H_{25}O(eth.ox.)_2H$
5 parts of $POCl_3$ ester: basis $C_{16}H_{33}O(eth.ox)_8H$, both adjusted to pH 7 by means of NaOH,
4 parts of $H_2O$
2 parts of i-propanol.

* * * * *